US006935240B2

(12) United States Patent
Gosetti

(10) Patent No.: US 6,935,240 B2
(45) Date of Patent: Aug. 30, 2005

(54) METHOD OF FORMING INDICIA ON A GOLF BALL

(75) Inventor: Steven M. Gosetti, Providence, RI (US)

(73) Assignee: Acushnet Company, Fairhaven, MA (US)

( * ) Notice: Subject to any disclaimer, the term of this patent is extended or adjusted under 35 U.S.C. 154(b) by 107 days.

(21) Appl. No.: 10/012,538

(22) Filed: Dec. 12, 2001

(65) Prior Publication Data

US 2003/0106442 A1 Jun. 12, 2003

(51) Int. Cl.[7] ..... B41F 17/30; B41F 17/34; B41M 1/40

(52) U.S. Cl. ..... 101/491; 101/41; 101/DIG. 40; 101/487; 473/351

(58) Field of Search ..... 101/487, 488, 101/35, 41, 33, 34, 491, 492, DIG. 40; 473/125, 351, 378, 377; 156/230, 237, 239, 240, 277, 272.2; 264/132, 137, 234

(56) References Cited

U.S. PATENT DOCUMENTS

| | | | | |
|---|---|---|---|---|
| 4,139,343 A | * | 2/1979 | Steiner | 8/467 |
| 5,334,673 A | | 8/1994 | Wu | 273/235 R |
| 5,484,870 A | | 1/1996 | Wu | 528/28 |
| 5,792,008 A | | 8/1998 | Kakiuchi et al. | 473/354 |
| 5,803,831 A | | 9/1998 | Sullivan et al. | 473/374 |
| 5,908,358 A | | 6/1999 | Wu | 473/378 |
| 6,179,732 B1 | | 1/2001 | Inoue et al. | 473/409 |
| 6,187,864 B1 | | 2/2001 | Rajagopalan | 525/183 |
| 6,210,294 B1 | | 4/2001 | Wu | 473/377 |
| 6,245,862 B1 | | 6/2001 | Rajagopalan | 525/340 |
| 6,450,900 B2 | * | 9/2002 | Kametani et al. | 473/377 |
| 6,490,968 B2 | * | 12/2002 | Lutz et al. | 101/35 |
| 6,524,419 B1 | * | 2/2003 | Dabrowski et al. | 156/230 |
| 2001/0036871 A1 | * | 11/2001 | Lampinski et al. | 473/351 |
| 2002/0039928 A1 | * | 4/2002 | Spurgeon et al. | 473/125 |
| 2002/0103034 A1 | * | 8/2002 | Kammerer et al. | 473/54 |

FOREIGN PATENT DOCUMENTS

| | | | |
|---|---|---|---|
| JP | 62-34582 | * | 2/1987 |

* cited by examiner

*Primary Examiner*—Leslie J. Evanisko
(74) *Attorney, Agent, or Firm*—Swidler Berlin LLP

(57) ABSTRACT

A method for forming indicia on a three-dimensional surface, in particular golf ball components, such as dimpled covers, cores, intermediate layers, and half shells, using dye sublimation, wherein the indicia is offered an improved level of protection from degradation during normal ball use due to diffusion of the sublimating ink into the surface of the component. The indicia can be applied to painted, unpainted, or coated surfaces.

26 Claims, 2 Drawing Sheets

DYE SUBLIMATION ON A THREE-DIMENSIONAL SURFACE

DYE SUBLIMATION ON A THREE-DIMENSIONAL SURFACE

DYE SUBLIMATION ON A MULTI-COMPONENT OBJECT

METHOD OF FORMING INDICIA ON A GOLF BALL

FIELD OF THE INVENTION

The present invention relates to a method of forming indicia on three-dimensional surfaces. In particular, the invention is directed to a novel method for applying an image to golf ball components using sublimating inks.

BACKGROUND OF THE INVENTION

There are many well known methods for applying indicia, designs, logos, and other decoration to three-dimensional surfaces. Printing indicia on a variety of three-dimensional surfaces, such as sporting goods, in particular, the dimpled surface of golf balls and other golf equipment, is often used as a means of advertising and labeling.

There are different approaches commonly used, mostly water-based or solvent-based systems, to add indicia to the dimpled surface of a golf ball. One approach involves first creating a decal of the logo or indicia that is to be printed on the golf ball surface, applying the decal to the spherical, dimpled golf ball surface of the cover, and then spraying the golf ball surface and decal with a clear finish coating. Pad printing is also often used for marking golf ball surfaces, however, very few of the inks employed in pad printing are suitable for use on a golf ball. More specifically, when applied to a golf ball, these inks are not sufficiently durable (impact resistant) to withstand multiple blows by a golf club. U.S. Pat. No. 6,179,732 discloses a method for applying markings to a golf ball during formation using a two-part mold and a mark-bearing film on the wall of the mold.

During manufacturing of golf balls using conventional printing methods, ink transfer problems are often encountered. For example, in pad printing it is desirable that all of the ink picked up by the printing pad be fully released onto the article to be printed, however, sometimes complete release is not achieved. Consequently, subsequent articles to be printed upon by the same printing pad member can have excessive ink or misaligned ink deposited thereon leading to unwanted ink contamination of balls. Resolution of such problems requires expensive positioning equipment to prevent unwanted contact between balls, between ink depositing members and balls, and between ball handling equipment and balls, respectively.

In addition to the problems associated with ink transfer before the ink is cured, post manufacturing problems are also commonly encountered even after curing takes place. The current water-based inks that work reasonably well for printing on absorbent substrates such as paper, paperboard, boxboard, and cardboard do not adhere well to the smooth, nonporous materials typically used in layers of a golf ball. To reduce adherence problems, golf balls generally are subjected to a clear coat covering the golf ball and the printed pattern after an indicia is applied in order to improve appearance as well as to protect the indicia from degradation during the golf ball's normal useful life due to normal play. There are multiple sources of possible degradation to the ball. For example, the ball may be degraded from being struck with a grooved club head or by landing on a rocky or abrasive surface such as a cart path. When adhesion between the protective clear coat and the ink layer of the printed pattern is weak, however, the ink layer can flake, crack, or otherwise degrade more easily under less harsh circumstances. After repeated impacts, such lack of adhesion, toughness, flexibility, and/or hardness yields an unsightly golf ball.

Because a clear coat is typically applied to a golf ball after printing the indicia, custom orders, e.g., imprinting a company logo for a relatively small quantity order, usually requires a special production run that tends to be expensive for the consumer.

Furthermore, water-based coatings, in general, while desirable due to the low toxicity of the solvent, are much harder to evaporate than volatile organic materials, and therefore, are energy intensive, requiring expensive drying ovens to remove the water.

Moreover, coatings and inks used in spraying and pad printing techniques typically involve volatile organic compounds (VOC) found in the compounds used. Manufacturers of printed products may be strongly affected by federal and local regulations that impose restrictions on the emission of VOCs, such as methyl ethyl ketone, acetone, toluene, alcohols, and chlorinated solvents, to the atmosphere.

The imaging of textiles and other materials using thermal transfer of sublimable dyes has been commercially practiced for more than 50 years. Sublimation transfer processes have been found to be particularly useful in printing onto polyester fabric. Excellent color quality and efficient transfer is possible with such fabrics, but poor results have previously been obtained on non-textile items such as wood, particle board, plastic sheets, leather, rubber and other organic or natural materials.

In general, sublimation printing requires a temporary support, such as a carrier or transfer sheet, having a sublimable ink and other components applied thereto. Application of the ink onto a substrate can take place by a number of well known techniques such as rotogravure, offset or flexographic printing. The temporary support is brought into contact with the substrate, generally a textile material. Application of heat and pressure cause the dispersed dyes in the ink to evaporate and migrate from the temporary support into the substrate being processed. The method is clean, fast, and without the emanation of noxious vapors and solvents. Other materials such as steel, aluminum, and composite materials such as graphite, wood, ceramic, clay, and glass, have also been successfully marked using dye sublimation, however, the melting temperatures of these substrates have all been substantially high so as to withstand the traditional high temperatures and pressures of the dye sublimation process.

The present invention provides a novel method for forming indicia on a three-dimensional surface, in particular, components of a golf ball, through dye sublimation that advantageously provides increased indicia durability and decreased VOC emission to the environment. The present invention also allows for indicia to be applied to interior surfaces of golf ball components before applying subsequent layers thereon.

SUMMARY OF THE INVENTION

The present invention is directed to a method of forming an indicia, preferably at least one color, on a golf ball including forming at least one golf ball component having an outer surface and subjecting the at least one golf ball component to at least one sublimating ink that migrates at a depth into the outer surface and forms the indicia. The at least one sublimating ink preferably includes at least one of an azo dye, a nitroarylamine dye, or an anthraquinone dye.

In one embodiment, the outer surface of the at least one golf ball component is dimpled and the outer surface is painted prior to subjecting the at least one golf ball component to at least one sublimating ink. In another embodiment, the outer surface of the at least one golf ball component subjected to at least one sublimating ink and then the outer surface is painted.

In yet another embodiment, the subjecting at least one golf ball component step is performed at a heat and a pressure for a period of time. Preferably, the heat and pressure is insufficient to cause permanent deformation of the golf ball component. The heat, the pressure, and the period of time may be moderated so that the depth of migration is controlled.

In one embodiment, the at least one golf ball component is an inner layer with an additional layer formed thereon.

The present invention is also directed to a method of printing at least one indicia on a golf ball including: forming a first golf ball component having a first outer surface; subjecting the first golf ball component to a sublimating ink that diffuses into the first outer surface and forms a first indicia; forming a second golf ball component having a second outer surface around the first golf ball component; and subjecting the second golf ball component to a second sublimating ink that diffuses into the second outer surface and forms a second indicia.

In one embodiment, the first indicia is the same as the second indicia. In another embodiment, the first sublimating ink is the same as the second sublimating ink. Preferably, the first indicia and the second indicia includes at least one color.

In another embodiment, the second golf ball component is an outer cover. The outer cover may be painted prior to subjecting the second sublimating ink to the second outer surface. The outer cover may also be painted or coated after being subjected to a sublimating ink.

In one embodiment, the subjecting the first golf ball component step is performed at a heat and a pressure for a period of time, and wherein the heat and pressure is insufficient to cause permanent deformation of the first golf ball component. In another embodiment, the subjecting the second golf ball component step is performed at a heat and a pressure for a period of time, and wherein the heat and pressure is insufficient to cause permanent deformation of the second golf ball component.

In yet another embodiment, the method further includes forming an intermediate golf ball component, disposed between the first and second golf ball components, having an outer surface and subjecting the intermediate golf ball component to a sublimating ink that diffuses into the outer surface and forms a third indicia.

The present invention is also directed to a golf ball including at least one component having an outer surface, wherein the at least one component is subjected to at least one sublimating ink that migrates into the outer surface and forms a first indicia.

In one embodiment, the at least one component is an inner component with at least one second component having a second outer surface formed thereon. The at least one second component is then preferably subjected to a second sublimating ink that migrates into the second outer surface and forms a second indicia. In one embodiment, the first indicia and the second indicia are the same.

The present invention is also directed to a method of tracking at least one three-dimensional component through a production line and thereafter including the steps of: forming a first indicia on a surface of the at least one three-dimensional component; linking the first indicia with the at least one three-dimensional component in a stored record; and using the stored record to associate the at least one three-dimensional component with the first indicia after a discrete time interval.

The forming step preferably includes subjecting the at least one three-dimensional component to at least one sublimating ink that migrates into the surface.

In one embodiment, the method of tracking further includes forming a second three-dimensional component having a second surface around the at least one three-dimensional component; and subjecting the second three-dimensional component to a second sublimating ink that migrates into the second surface and forms a second indicia thereon. The forming steps are preferably performed at a heat and a pressure for a period of time, and wherein the heat and pressure is insufficient to cause permanent deformation of the at least one three-dimensional component and the second three-dimensional component. In one embodiment, the first indicia and the second indicia are the same.

In another embodiment, the at least one three-dimensional component is a golf ball component.

DETAILED DESCRIPTION OF THE INVENTION

This invention relates to the use of dye sublimation on three-dimensional surfaces, in particular on various components of a golf equipment, such as golf ball components, so that the various layers or components can be decorated with a durable indicia or image. As used herein, "golf equipment" is defined as golf balls, golf gloves, golf shoes, golf clubs, and the like. As used herein, the term "sublimable" or "sublimation" is defined as the conversion of a solid dye particle to a gaseous or vapor state. The term "sublimation" is also used interchangeably with the term "vaporization" in the printing art as describing a process by which the dye migrates from the dye carrier as a vapor or gas to the substrate, even though the two terms describe different thermodynamic phenomena of a solid particle converting to a vapor or gas. The migration or sublimation process is also called vapor phase printing, a process which includes the absorption and penetration of dye into the surface of the substrate.

Figure 1:
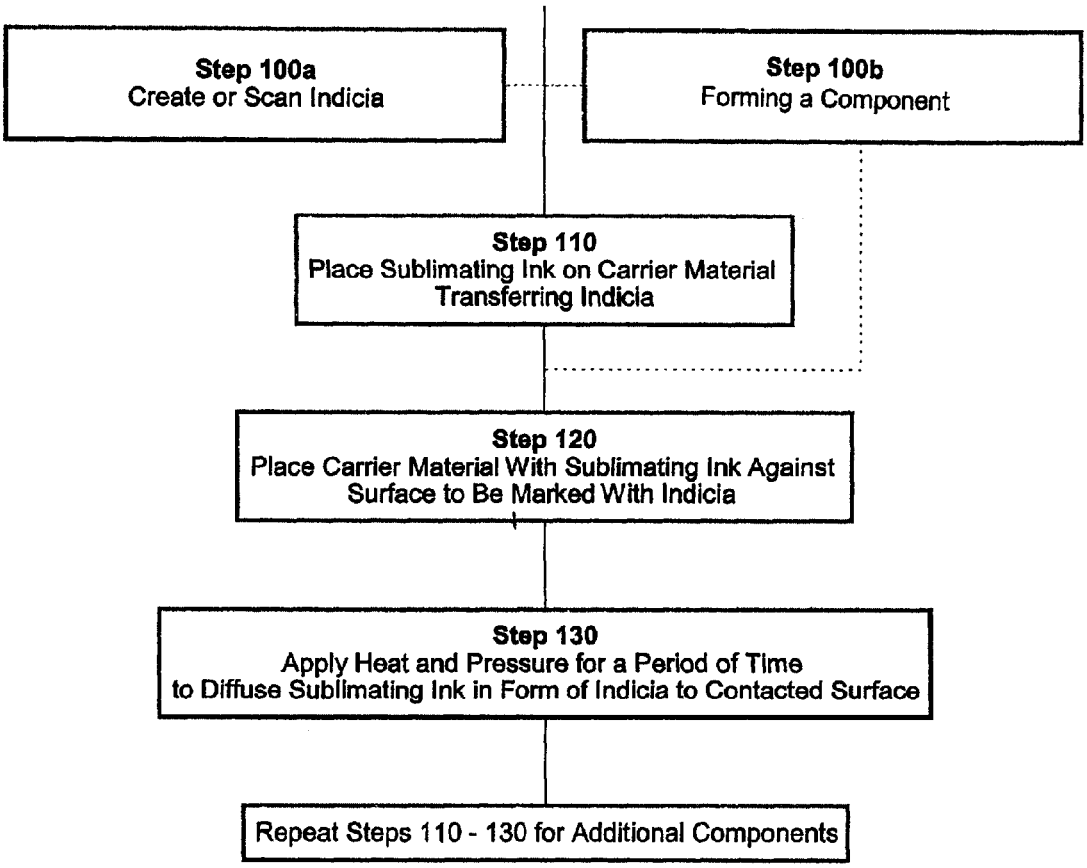
FIG. 1 is a flow chart outlining the general steps of using dye sublimation on a three-dimensional object.

FIG. 1 shows the general order of the steps when using dye sublimation to form an indicia on a three-dimensional surface. While this process is described below with reference to a golf ball component, the present invention is not limited to use with golf ball components. One of ordinary skill in the art would recognize the applicability of dye sublimation on a variety of three-dimensional objects. The first steps of the process are somewhat flexible in order. Steps 100*a* and 100*b* can be performed before, after, or simultaneously with respect to each other to optimize for maximum production yield and efficiency.

A potential beginning step can be to create an indicia to be applied to the golf ball component. As used herein, the terms "indicia," "pattern," "image," or "logo" are the same for purposes of this invention and are considered to mean any symbol, letter, group of letters, design, image, bar code, or the like, that can be added to a three-dimensional surface.

The indicia can be made in any manner known to those of ordinary skill in the art (Step 100*a*). For example, the indicia can be created with a computer using a software program such as Adobe Photoshop®, Adobe Illustrator®, or the like. The indicia can also be a hand drawn image that is scanned into digital memory. The indicia can be one or several spot colors or full color.

Another possible initial step of the process can be to form a component (Step 100*b*). The golf ball component can be formed prior to creation of the indicia or after creation of the indicia, and even after the image transfer material is created (Step 110), but must be formed prior to Step 120.

The component can be formed using any technique known to one of ordinary skill in the art. For example, when the component is a golf ball component, the component may be a solid ball, a unitary ball, a multi-layer ball, a wound ball, or any combination thereof. The golf ball component could also be a half shell intended to be clipped or molded together with another half shell. As used herein, the term "multi-layer" means at least two layers and includes fluid-center balls, hollow-center balls, or balls with at least two intermediate layers and/or cover layers.

Among other advantages, the present invention enables decoration of surfaces that would normally have poor adhesion to coatings, e.g., polyolefins or other materials containing slip agents. Thus, the present invention enlarges the possible selection of materials of any particular component intended for marking or coating. While the present invention is not limited to particular materials, non-limiting examples of golf ball component materials are disclosed below. For example, the core of a multi-layer ball may be formed of thermoset or thermoplastic materials, such as polybutadiene, thermoplastic polyesterester, thermoplastic polyetherester, dynamically vulcanized thermoplastic elastomers, functionalized styrene-butadiene elastomers, thermoplastic urethanes, metallocene polymers, or blends thereof. Suitable intermediate and cover layer materials for use with the present invention include, but are not limited to, thermoset or thermoplastic materials, ionomer resins, polyurethanes, metallocene-catalyzed polymers, balata, polyolefins and their copolymers, polyureas, polyamides, and other cover materials known by those of ordinary skill in the art. Non-limiting examples of cover materials and methods for forming the cover layers can be found in U.S. Pat. Nos., 6,245,862, 6,210,294, 6,187,864, 5,908,358, 5,803,831, 5,792,008, 5,484,870, and 5,334,673, the disclosures of which are incorporated by reference herein.

After the indicia is created, the next step involves manufacturing the image transfer material (Step 110) through placing the sublimating ink on a carrier material to transfer the indicia. This step can be accomplished using established imaging technologies such as offset printing (lithographic printing), silk screen printing, ink jet printing, or the like. The indicia can be transferred under heat, and usually pressure, onto a carrier material (Step 110) using, for example, etched gravure press cylinders and standard lithographic paper. The carrier material must be receptive to inks containing sublimable dye colorants having the property of subliming or vaporizing to a gas when heated. Suitable sublimating inks include, but are not limited to, azo dyes, nitroarylamine dyes, and anthraquinone dyes.

The next step in the process involves placement of the carrier material against the surface of the golf ball component to be marked with the indicia (Step 120). This step can be accomplished through any suitable method allowing correct placement of the carrier material against the surface, as well as providing a means to assure intimate contact between the carrier material and the component surface without possibility of slipping or shifting during the next step.

After the carrier material is in contact with the surface to be marked, the next step involves applying heat and pressure for a set period of time to diffuse the sublimating ink from the carrier material into the surface of the component (Step 130). In one embodiment, the sublimating ink is applied directly to the surface to be marked using traditional application methods in lieu of carrier material, such as ink-jet printing or pad-printing, and triggered after a discrete interval by using heat and pressure for a set period of time to diffuse the ink into the surface of the component. The ink is vaporized, converting it from a solid to a gas, and transferred as a gas, imagewise to penetrate into the surface of the golf ball. The indicia becomes part of the substrate and becomes very durable. The depth of migration into the surface depends on pressure, temperature, and time of the transfer. The composition of the sublimating ink and the resistance of the material that the ink is migrating through can also effect migration depth. The process should be controlled so that the temperature and pressure are below that which causes deformation of the material of the component. For example, the melting temperature of SURLYN®, an ionomer resin, is from about 70° C. to about 100° C., and when using SURLYN®as a component to be marked with the indicia using the dye sublimation process, Step 130 should be controlled to stay below that range.

Preferably, there is no deformation of components when using the dye sublimation process, particularly when the golf ball component to be marked with indicia is the outermost layer of the golf ball, i.e., the cover. It is acceptable, however, when the component to be marked is an inner layer, e.g., a core layer or an intermediate layer, that slight deformation occurs.

When the component to be marked with indicia is a golf ball cover, the cover can be treated or untreated prior to the dye sublimation process. As used herein, the terms "treated," "primed," and "painted," are the same for the purposes of the invention and are considered to encompass any type of preparation work performed on a golf ball component. Golf ball covers are commonly painted with a primer coat which can be colored (e.g., white) or transparent. In one embodiment, Step 120 occurs after the cover surface is primed or painted. Alternatively, the cover material itself can contain a colorant, such as balata or ionomer resin, and the indicia can be applied directly to a cover material.

A tough, often glossy, clear coat is sometimes applied over the cover and/or the primer coat to form a protective outer seal on the golf ball. The clear coat can include, for example, a two component urethane. The clear coat is used to increases the shine (i.e., glossy appearance) of the golf ball to enhance or brighten its appearance. The clear coat could also be mixed with pigments to add color to the ball, often referred to as a "top coat." As used herein, the terms "clear coat" and "top coat" are the same for the purposes of the invention and are considered to encompass any final coating, i.e., clear or pigmented, applied to a golf ball component. In contrast to other printing methods, one embodiment of the invention makes it possible for the golf ball to be clear coated prior to application of the indicia with the sublimating ink (Step 120). This allows special production runs, i.e., imprinting a company logo or trademark onto a relatively small quantity of golf balls, to be more cost effective as it would not be necessary to shut the main production line down for the custom run. In another embodiment, the top coat is applied after subjecting the golf ball component to sublimation.

In one embodiment, the inner components of a golf ball, e.g., the core or intermediate layers, as well as the outer components, can be tracked using an indicia, or other identifying mark, e.g., a bar code. Dye sublimation is the preferred indicia application method for tracking, however, other methods such as infrared dye, paint or surface ink, fluorescent marking, phosphorescent marking, radioopaquing, and the like can also be used for tracking the various components of a golf ball, or any other three-dimensional object components. This method of tracking can be useful for golf ball manufacturers to track a particular golf ball component through production or through the lifetime of the ball. Furthermore, this indicia could be helpful to deter golf ball refurbishers from using a manufacturer's golf ball and recovering to claim as their own.

For example, some golf ball manufacturers currently use a lettered or numbered marking situated in various dimples of a golf ball outer cover for identification purposes. The markings protrude slightly from the surface and to the untrained eye, may look as if the outer cover has imperfections. Using dye sublimation, an indicia may be applied to at least one of the innermost component, various intermediate components, or outermost component, advantageously allowing for a visible and understandable tracking system for all components of a golf ball, both during production and throughout the useful life of the golf ball. The indicia may also be altered slightly for each component allowing identification of the specific golf ball as well as the specific component of the golf ball.

Figure 2:
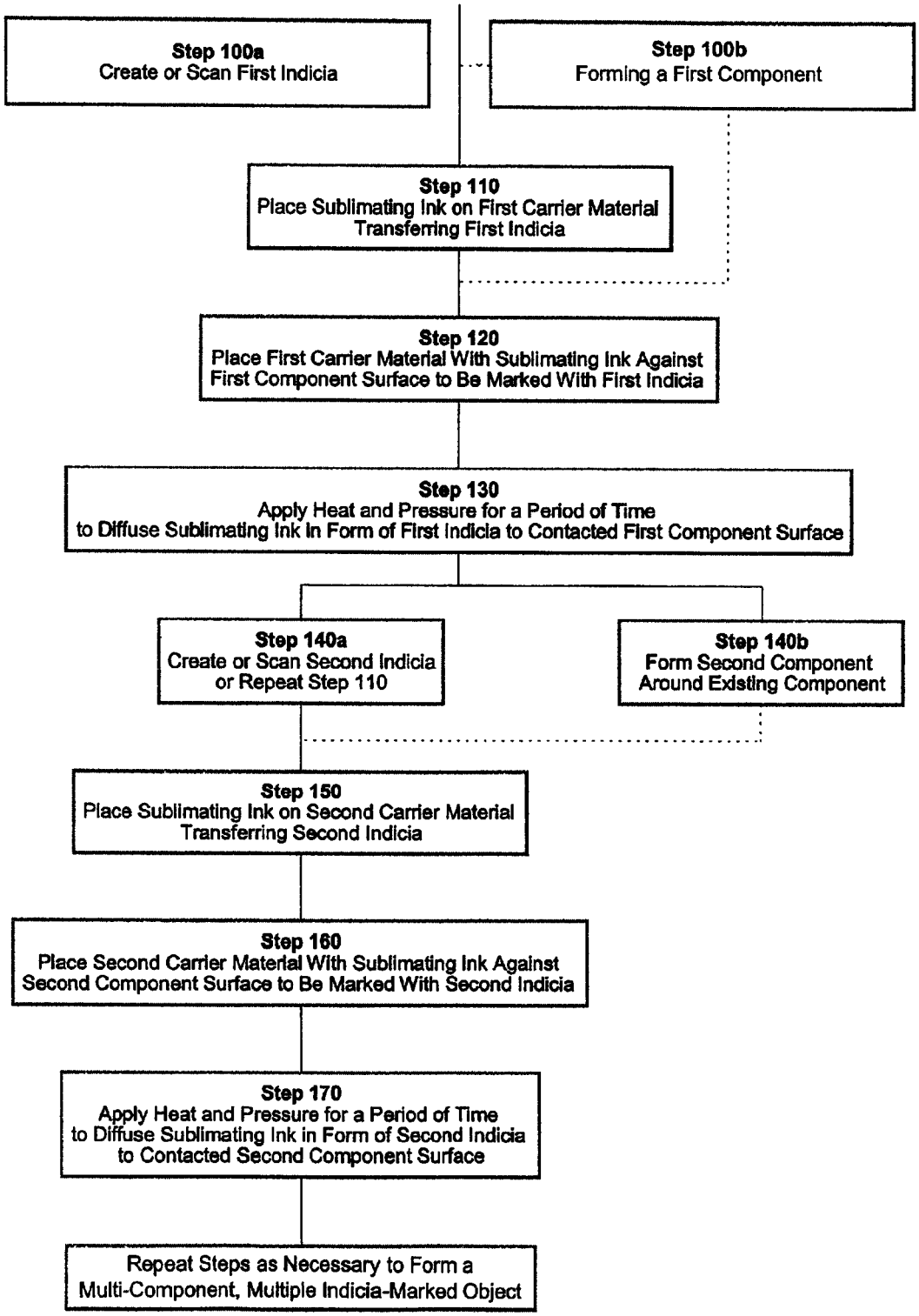
FIG. 2 is a flow chart outlining the steps of applying indicia to multiple components of an object according to one embodiment of the invention.

FIG. 2 shows an embodiment of the invention wherein a multi-component three-dimensional object has several components marked with indicia. The dye sublimation process advantageously allows for each component, or a selection of components, to be marked with the same or different indicia as the ball is constructed. Steps 100–130 are identical to those discussed in reference to FIG. 1.

Initially a first indicia is created or digitally obtained (Step 100*a*) and a first component is formed (Step 100*b*). Steps 100*a* and 100*b* can reversed in order to maximize production efficiency. The first indicia is then transferred to a first carrier material using a sublimating ink (Step 110). Step 100*b* can also occur after Step 110 to maximize process efficiency. After the first carrier material is created, it is then placed against the first component surface (Step 120), and heat and pressure are applied for a period of time to allow the sublimating ink to migrate into the first component (Step 130).

Once the indicia marking of the first component is complete, a second component can then be formed around the first component (Step 140*b*). If necessary, a second indicia, distinctly different than the first indicia is created or digitally obtained (Step 140*a*). The next step involves the transfer of the second indicia to a second carrier material using a sublimating ink (Step 150). Steps 140*a* and 150 can also be performed at the same time as Steps 100*a* and 110 for maximum efficiency. If the same indicia is to be used throughout the multiple layers of the object, Step 110 is repeated to obtain the second carrier material and this repeated step can be performed prior to Step 120.

The second carrier material is then placed against the second component (Step 160). Heat and pressure are applied for a period of time to allow the sublimating ink to migrate into the second component (Step 170). The temperature, pressure, and time are controlled to determine migration depth and avoid deformation of the component being marked and the first component.

Subsequent components can then be further applied to the existing components by repeating Steps 140–170 as necessary, each layer having either similar or distinctly different indicia from the core or each other. In one embodiment, intermediate layers absent of indicia can be formed around marked layers. The components may be treated or untreated prior to sublimation and a top coat or clear coat may be applied before or after sublimation.

It is to be understood that the invention is not to be limited to the exact configuration as illustrated and described herein. For example, it should be apparent that a variety of materials would be suitable for use in the composition or method of making the golf ball according to the Detailed Description. In addition, the golf ball component to be marked with an indicia may be a half shell and the carrier material with the sublimating ink may be applied to the interior or exterior of the half shell. In another embodiment, a golf ball consists of various components subjected to sublimation and other components marked with traditional methods, e.g., pad-printing. Accordingly, all expedient modifications readily attainable by one of ordinary skill in the art from the disclosure set forth herein, or by routine experimentation therefrom, are deemed to be within the spirit and scope of the invention as defined by the appended claims.

What is claimed is:

1. A method of forming an indicia on a golf ball comprising the steps of:

forming at least one golf ball component having an outer surface;

painting the outer surface; and subjecting the at least one golf ball component to at least one sublimating ink at a heat and pressure for a period of time, wherein the heat and pressure are insufficient to cause permanent deformation of the at least one golf ball component, and wherein the at least one sublimating ink migrates at a depth into the outer surface and forms the indicia.

2. The method of claim 1, wherein the indicia comprises at least one color.

3. The method of claim 1, wherein the outer surface is dimpled.

4. The method of claim 3, wherein the outer surface is painted prior to subjecting the at least one golf ball component to at least one sublimating ink.

5. The method of claim 1, wherein the outer surface is painted with a clear coat.

6. The method of claim 1, wherein the at least one golf ball component comprises a material having a deformation point at a temperature and pressure, and wherein the subjecting step is performed at a heat and pressure below the deformation point.

7. The method of claim 1, wherein the heat, the pressure, and the period of time are moderated to control the depth of migration.

8. The method of claim 1, wherein the at least one sublimating ink comprises at least one of an azo dye, a nitroarylamine dye, or an anthraquinone dye.

9. The method of claim 1, wherein the at least one golf ball component is an inner layer with at least one additional layer formed thereon.

10. The method of claim 1, wherein the indicia comprises at least one symbol, letter, group of letters, design, image, bar code, or combinations thereof.

11. The method of claim 1, wherein the subjecting step further comprises the steps of:

providing a carrier material;

placing the indicia on the carrier material using at least one sublimating ink;

placing the carrier material against a portion of the at least one golf ball component.

12. A method of printing at least one indicia on a golf ball comprising the steps of:

forming a first golf ball component having a first outer surface;

subjecting the first golf ball component to a sublimating ink that diffuses into the first outer surface and forms a first indicia;

forming a second golf ball component having a second outer surface around the first golf ball component; and subjecting the second golf ball component to a second sublimating ink that diffuses into the second outer surface and forms a second indicia.

13. The method of claim 12, wherein the first indicia is the same as the second indicia.

14. The method of claim 12, wherein the first indicia and the second indicia comprise at least one color.

15. The method of claim 12, wherein the first sublimating ink is the same as the second sublimating ink.

16. The method of claim 12, wherein the second golf ball component is an outer cover.

17. The method of claim 16, wherein the outer cover is painted prior to subjecting the second golf ball component to the second sublimating ink.

18. The method of claim 16, wherein the outer cover is painted with a clear coat.

19. The method of claim 12, wherein the subjecting the first golf ball component step is performed at a heat and a pressure for a period of time, and wherein the heat and pressure is insufficient to cause permanent deformation of the first golf ball component.

20. The method of claim 12, wherein the subjecting the second golf ball component step is performed at a heat and a pressure for a period of time, and wherein the heat and pressure is insufficient to cause permanent deformation of the second golf ball component.

21. The method of claim 12, further comprising:

forming an intermediate golf ball component, disposed between the first and second golf ball components, having an outer surface; and subjecting the intermediate golf ball component to a third sublimating ink that diffuses into the outer surface and forms a third indicia.

22. A golf ball comprising a core and a cover disposed about the cover, wherein the core has at least one sublimating ink diffused therein to form a first indicia, and wherein the cover has a second sublimating ink diffused therein to form a second indicia.

23. The golf ball of claim 22, wherein the first indicia and the second indicia are the same.

24. The golf ball of claim 22, wherein the core comprises a center and an intermediate layer disposed about the center.

25. The golf ball of claim 24, wherein the intermediate layer has the at least one sublimating ink diffused therein.

26. The golf ball of claim 22, wherein the first indicia is different than the second indicia.

* * * * *